US006003943A

United States Patent [19]

Schneider

[11] Patent Number: 6,003,943

[45] Date of Patent: Dec. 21, 1999

[54] MULTI-FUNCTION CONTROL FOR CHAIR

[75] Inventor: Jean-Marc Schneider, Sarrebourg, France

[73] Assignee: Steelcase Development Inc., Grand Rapids, Mich.

[21] Appl. No.: 09/174,941

[22] Filed: Oct. 19, 1998

Related U.S. Application Data

[63] Continuation of application No. 08/838,617, Apr. 10, 1997.

[30] Foreign Application Priority Data

Apr. 22, 1996 [EP] European Pat. Off. ..... 96440031

[51] Int. Cl.[6] ..... A47C 3/00; B21D 39/03

[52] U.S. Cl. ..... 297/303.3; 297/301.3; 297/344.19; 29/428

[58] Field of Search ..... 29/428; 297/344.19, 297/303.1, 303.4, 463.1, 463.2, 303.3, 300.4, 300.5, 302.3, 302.4, 344.12, 344.18, 301.3, 301.4

[56] References Cited

U.S. PATENT DOCUMENTS 3,756,654 9/1973 Bauer .
4,328,943 5/1982 Eldon, III .
4,373,692 2/1983 Knoblauch et al. .
4,561,693 12/1985 Brownline et al. .
4,595,237 6/1986 Nelsen .
4,709,963 12/1987 Uecker et al. .
4,779,925 10/1988 Heinzel .
4,916,968 4/1990 Kabaya .
5,106,157 4/1992 Nagelkirk et al. .
5,222,783 6/1993 Lai .
5,244,253 9/1993 Hollington et al. .
5,427,434 6/1995 Hybarger .
5,577,804 11/1996 Tedesco .
5,577,807 11/1996 Hodge et al. .

*Primary Examiner*—Milton Nelson, Jr.
*Attorney, Agent, or Firm*—Price, Heneveld, Cooper, DeWitt & Litton

[57] ABSTRACT

A chair includes a seat, a base including a housing, and a reclineable back pivoted to the housing. The chair further includes a pneumatic system having a valve actuateable to adjust a height of the seat with respect to the base, a cam for blocking the degree of tilt of one of-the back and seat, and a spring for supporting the reclineable back. A multi-functional member or "satellite" control is operably mounted to the housing and includes a first spindle translatable for pulling the cable to open and close the valve for adjusting the height of the seat. The first spindle is further rotatable to operate the cam to at least partially immobilize the back. The multifunctional member further includes a second spindle including a threaded portion engaging a nut for adjusting the tension of the spring when the second spindle is rotated. The second spindle is rotatably mounted in the first spindle.

18 Claims, 6 Drawing Sheets

MULTI-FUNCTION CONTROL FOR CHAIR

CROSS-REFERENCE TO RELATED APPLICATION

This application is a continuation application of co-assigned, copending application Ser. No. 08/838,617, filed on Apr. 10, 1997, entitled MULTI-FUNCTION CONTROL FOR CHAIR.

BACKGROUND OF THE INVENTION

This invention relates to improvements in office chairs and more specifically to improvements to adjustment and control systems for the various movable and shapeable parts of an office chair.

It is known to use a pneumatically operated adjustment mechanism in chairs. The adjustment results from telescopic engagement between two portions actuated by a jack. Preferably, the pneumatic system includes a cartridge or "jack" containing a compressed gas feeding two coaxial cylinders embodying the two portions, the control of communication between the cylinders being provided by opening or closing a control valve. Such a system is described, for example, in the French Patent No. 2,025,110.

It is also known to allow a tilting of the back portion upon the seat portion. The tilting is lockable in each of two end positions or in one of a series of intermediate positions.

It is also known to allow an adjustment of the tilting tightness or tension of the chair (i.e., of the seat portion and/or of the back portion). For example, by using a twisting spring wound around the tilting shaft, the adjustment resulting from the twisting torque is applied to the spring. A typical mechanism of this kind makes use of the position of a translating movable element.

All such adjustment and control possibilities offer to the user a maximal comfort whatever his/her size, his/her conformation, and the conditions of use of the chair. Most of the adjustment and control possibilities, however, have a drawback in that they are independently located and distributed in various locations under the seat, which requires a good deal of trial and error from the user when he/she wants to select the adjustment he/she wants to act upon.

Indeed chairs already exist in which some controls are grouped or coupled with a view to be acted upon a reduced member of control members.

For example, each of the documents WO 81/03605 and French Patent No. 2,460,648 disclose an armchair in which the height adjustment of the seat and the tilt adjustment of the back are controlled through an unique rotative member (i.e., a cam), which act, depending upon its angular position, upon one or the other of two valves equipping two pneumatic cylinders controlling the adjustments. This control member is unique, but it does not provide the user with a differentiation between the two adjustments.

European Patent No. 0,385,473 discloses a chair having systems for adjusting the height and the tilting tension, the systems being controlled through two distinct organs located at the same place. However, there does not exist means for adjusting the degree of tilt which, if they would be coupled with the adjustment systems, could be actuated at the same place under the seat.

European Patent No. 0,592,008, which is a division of the precedent, has the same limitations. In both last documents, the mechanism is extremely complicated.

Reversely, European Patent No. 0,549,026 discloses a chair having a mechanism which can be called "global" but very simple and that is adapted to selectively control the seat height and the back tilting. The mechanism comprises an activation lever designed to take different positions in which, through proper linkages, it gives various configurations to the chair elements, somewhat like shifting gears. It is, therefore, not really a control for different adjustments.

It appears therefore that, in the prior art, a number of attempts have been made to allow a seated user to proceed with the various possible adjustments of said seat through organs grouping or coupling several controls together, but that none of such adjustment mechanisms have been designed for the three said adjustments with a differentiation of the adjustment controls.

SUMMARY OF THE INVENTION

In one aspect of the present invention, a method of assembling a chair control for a chair includes movable parts. The method includes steps of providing a control housing and providing a multi-functional member operably supported on the control housing. The multi-functional member includes a first control member constructed to translate for controlling a first one of the movable parts, and constructed to rotate for controlling a second one of the movable parts. The first control member includes a rotatable sector having an arcuate slot, and includes a cable adapted for connection to the first one of the movable parts. The cable includes a first end and slidably retains the first end in the arcuate slot, so that the first end slides in the arcuate slot when the first control member is rotated, and translates when the first control member is translated.

In another aspect of the present invention, a method of assembling a chair control includes movable parts. The method includes steps of providing a control housing and providing a multi-functional member operably supported on the control housing. The-multifunctional member includes a first control member constructed to translate for controlling a first one of the movable parts, and constructed to rotate for controlling a second one of the movable parts. A second control member is located proximate the first control member. The second control member is constructed to control a third one of the movable parts. The first and second members include first and second spindles, respectively. The first spindle is operably mounted on the second spindle and the first spindle is operably attached to the first and second movable parts, so that the first movable part is operated when the first spindle is translated and so that the second movable part is operated when the first spindle is rotated.

In another aspect of the present invention, a method of assembling a chair includes steps of providing a seat, providing a reclineable back, and providing a control housing including a cable. The method further includes assembling the seat and the reclineable back to the control housing, with at least one of the seat, the reclineable back, and the control housing including movable parts, and with the cable attached to a first one of the movable parts. The method also includes a step of providing a multi-functional member operably supported on the control housing. The multi-functional member includes a first control member constructed to translate for controlling the first one of the movable parts, and constructed to rotate for controlling a second one of the movable parts. The first control member includes a rotatable sector including an arcuate slot. The cable includes a first end slidably retained in the first end in the arcuate slot, so that the retained end slides in the arcuate slot and does not activate the first one of the movable parts when the first control member is rotated, but translates and does activate the first one of the movable parts when the first control member is translated.

In yet another aspect of the present invention, a method of assembling a chair includes steps of providing a seat, providing a reclineable back including a back support pivoted to the control housing and supporting the reclineable, providing a control housing including a rotary cam and a linkage, and assembling the seat and the reclineable back to the control housing. One or more of the seat, the reclineable back, and the control housing have movable parts. A multi-functional member is operably supported on the control housing. The multi-functional member includes a first control member constructed to translate for controlling a first one of the movable parts, and constructed to rotate for controlling a second one of the movable parts. The multi-functional member also includes a second control member constructed to rotate for controlling a third one of the movable parts. The method further includes operably connecting the linkage to one of the first and second members for rotating the cam upon operation of the one control member. The cam is constructed to engage a portion of the back support to selectively immobilize the back support.

In another aspect of the present invention, a method of adjusting a chair includes steps of providing a chair including a seat, a reclineable back, and a control housing including an elongated connector. The seat, the reclineable back, and the control housing include movable parts. The control further includes a multi-functional member including a first control member constructed to translate and control the first one of the movable parts, and constructed to rotate and control a second one of the movable parts. The multi-functional member further includes a second control member constructed to rotate and control a third one of the movable parts. The method further includes rotating the first control member to control the first one of the movable parts, translating the first control member to control the second one of the movable parts, and rotating the third control member to control the third one of the movable parts.

These and other aspects, objects, and advantages of the present invention will be understood and appreciated by those skilled in the art by reference to the present specification, claims, and appended drawings.

DESCRIPTION OF PREFERRED EMBODIMENT

Figure 1:
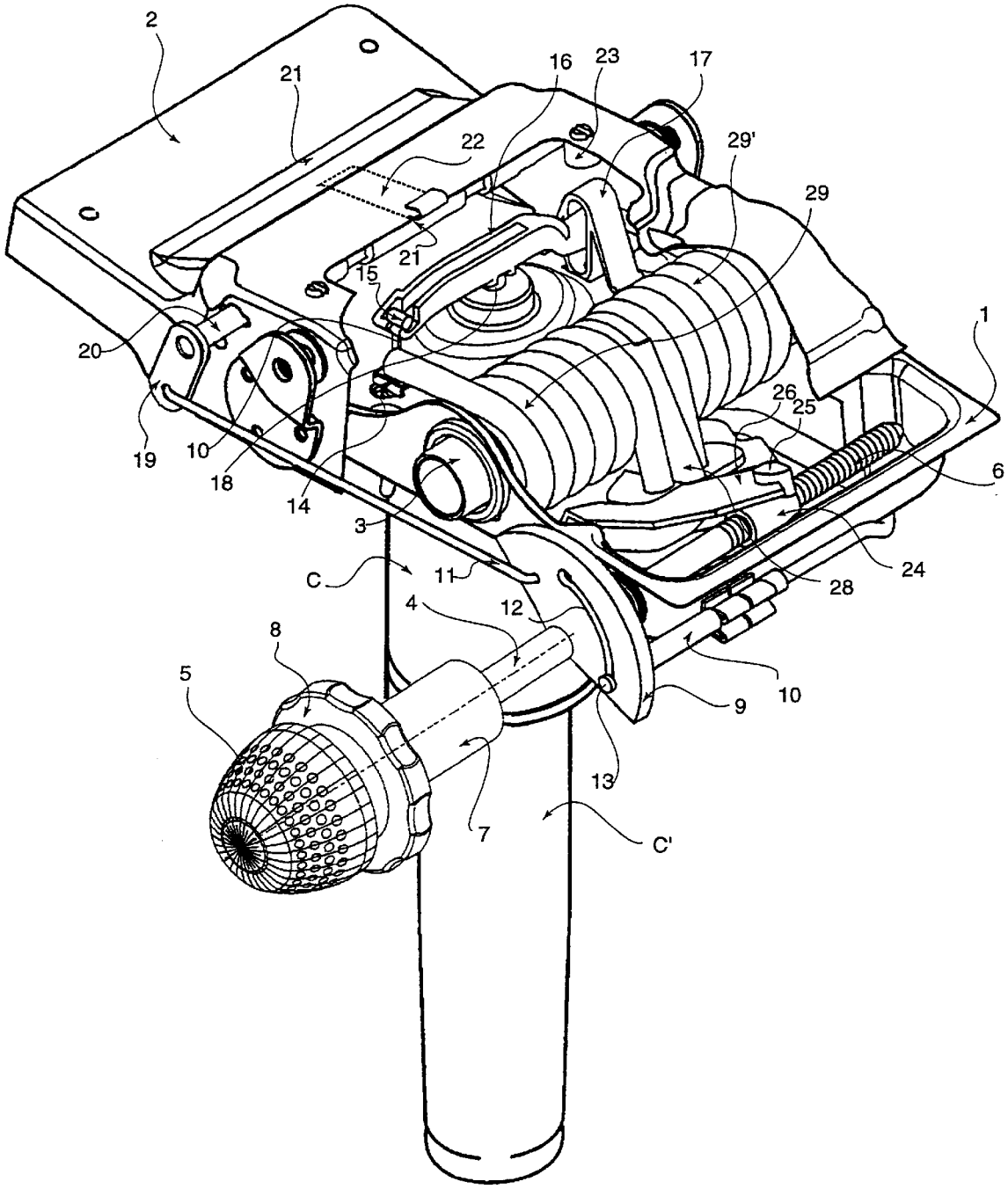
FIG. 1 is a perspective view from the top of the assembly of mechanisms of adjustment and control of an office chair grouped within a satellite according to the present invention, a part of the elements forming the chair (i.e., the seat and the back being omitted and the movable portion of the casing of said mechanism being partially broken away for clarity purposes)

This drawing illustrating one modification of the satellite of the present invention, the same numeral references show the same elements upon all figures.

On this drawing, reference 1 shows the bottom part of a casing which encloses all the various mechanisms for the adjustment and the control of an office chair which is mounted upon the upper portion C of a pedestal, the upper portion C being pivotably and axially mounted upon a fixed portion C' of said pedestal, not shown, since quite usual.

The upper part 2 of the same casing is mounted in an also usual manner tilting with respect to part 1 around an axis 3.

The bottom part 1 is connected to the seat (not shown), and the upper part 2 is connected to the back (not shown) of the chair.

In this preferred modification, the chair comprises three possibilities of adjustment, which are individually known, for example:

1. The adjustment of the chair (i.e., of the height of the integral assembly upper portion C of the pedestal/fixed portion or seat 1), with respect to the assembly pedestal and lower column portion C';
2. The adjustment of the angular tilting of the back (i.e., a control of the locking), in one of at least two extreme or preselected intermediate positions, of the tilting part 2 with respect to the fixed portion 1; and
3. The adjustment of the tilting tension (i.e., the elastic opposition or strength that the user should overcome to recline the back by leaning rearward, and which constitutes the forward return strength of the back when the user leans forward).

Usually, as explained here above, those three adjustments are controlled by three levers or knobs distributed under the seat, acting individually and independently each upon one of the mechanisms.

Figure 3:
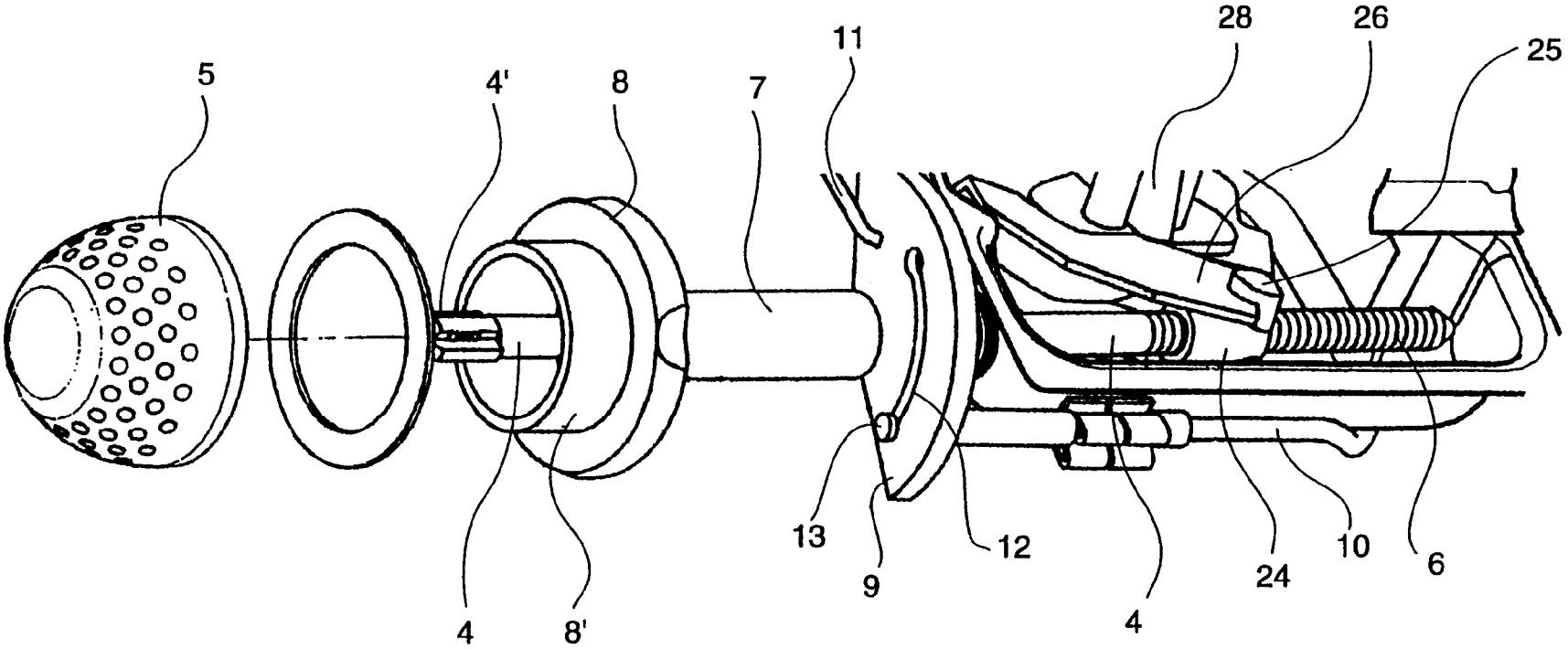
FIG. 3 is an exploded view of the arrangement of the control elements of the satellite.

According to the present invention, all the adjustments are controlled through one unique satellite, as shown more clearly in FIG. 3. As illustrated, the satellite comprises:

1. A first shaft 4 notched at its external end 4' to form a double slot to engage within a corresponding housing of cross section (not shown) of a control knob 5, and threaded at its internal end along a portion 6; and
2. A second shaft 7 mounted coaxially around the first shaft 4, axially and angularly movable, and having at its external end a control crown 8 spaced from knob 5 by a cylindrical ring 8', and at its internal end a sector 9 designed, as explained hereafter so that it can drive in its axial movement a cable 10, and in its angular movement a connecting rod 11.

All adjustments and controls mentioned here above are obtained separately and independently by simple using properly the knob 5 and the crown 8 as described hereafter.

Firstly, the height adjustment of the seat is controlled by axially moving crown 8, to axially pull axially the sector 9 to take it closer to knob 5. In the sector 9 is cut away a circular slot 12, through which is passed a cable having at its end a bead or enlargement 13 which keep the cable engaged through said slot 12. Due to this arrangement, pulling the cable 10 by axially moving the sector 9 toward the knob 5 is possible whatever the angular position of the sector 9, which permits the second function of crown 8 to be independently rotated.

The cable 10, from its end 13, through the sector 9, makes its way under the fixed part 1 of the casing. It passes through a hole 14 (FIG. 2) to grip at its opposed end, for example by another bead 15, to an end of a lever 16 (FIG. 1). The lever 16 tilts elastically upon a pivot 17 so that it normally keeps closed a valve 18 controlling the cartridge of compressed air. The valve 18 is connected to the telescopically engaging portion C and C' and the pedestal, and is operable to adjust the height of the seat as explained here above.

It is well understood that the elastic pivot 17 normally keeps the valve 18 in the closed position, so that, when not in use, the closed system is locking the seat at any preselected height, while exerting a return strength upon the cable 10. By axially pulling the crown 8, the cable 10 acts upon the lever 16, which opens the valve 18, connecting the two cylinders C and C', which allows the seat to be adjusted to any preselected height. Stopping the axial action upon crown 8 controls the cable 10 to return to its non-action upon the lever 16, which leaves the valve 18 to close said connection, locking the height of the seat in said new preselected height.

Figure 2:
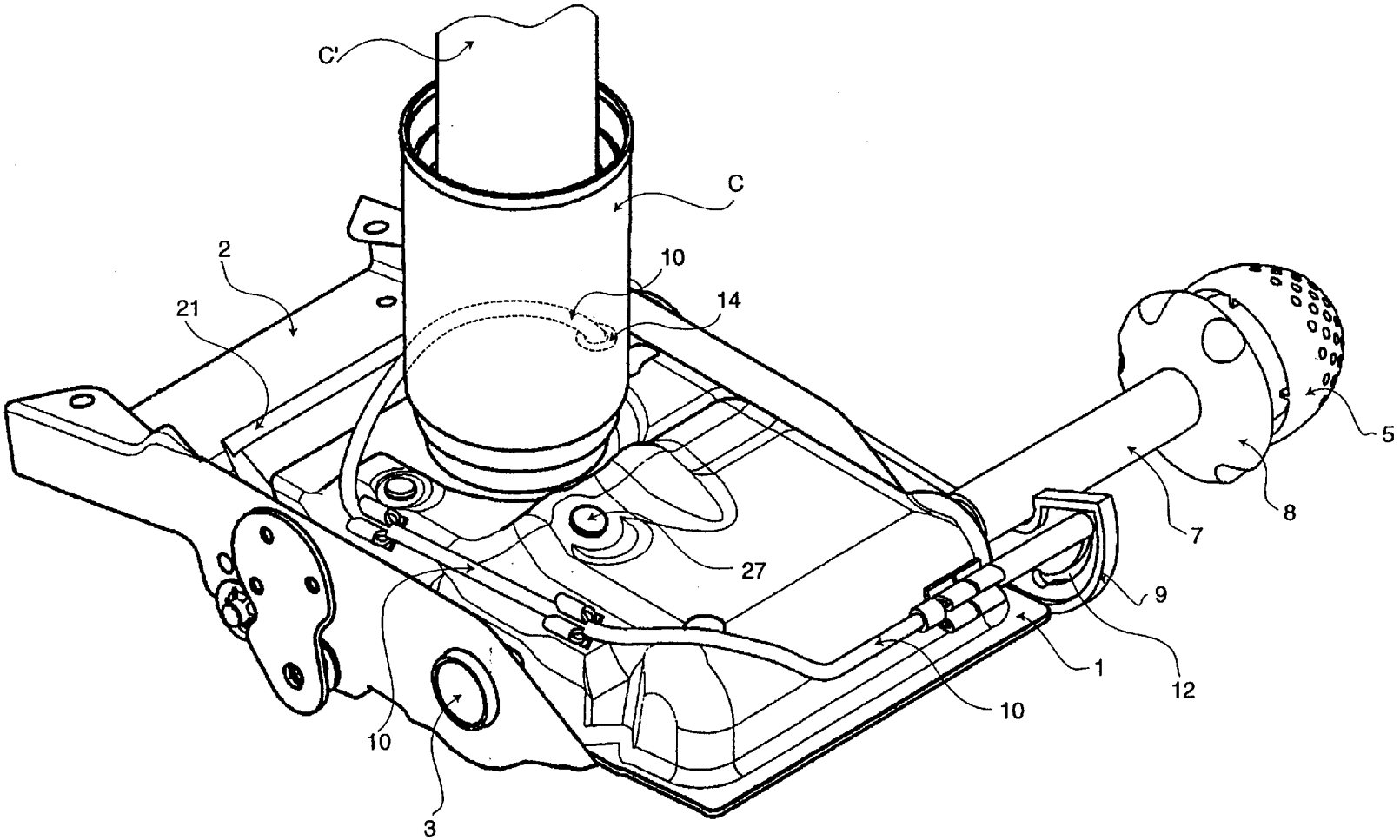
FIG. 2 is a perspective view from the bottom of the same assembly.

Secondly, the reclined position of the back is adjusted by acting upon the same crown 8, but totally with respect to the shaft 4. In this case, the connecting rod 11, fixed at one end to the sector 9, is fixed at its opposed end to a lever 19 (FIG. 1). Lever 19 is rotatively connected to an axis 20 upon which are fixedly mounted cams 21 made of plastic (FIG. 2). The cam 21, in at least one position, locks by friction the surface of the movable upper part 2 of the casing (which is connected to the back, as already explained). In this case, the back is therefore locked in its reclined position. When the axis 20 is rotated, by rotating action upon the crown 8, the cams 21 are no longer engaging the surface of the movable upper part 2, so that the back is freed to be reclined at will. This action is smoothened, for example, by a flexible blade 22 which engages the cams 21. Flexible stops 23 prevent an excessive movement of the freed back.

Such a reclining adjustment can be designed under a number of modifications, such as for example locking the back in foremost position, in multi-position, limited or any further function connected to the incline. The invention is intended to cover the control of all modifications, including the modification illustrated by FIG. 5 and described hereunder.

The use of crown 8 allows therefore the control of two functions of the chair. The knob 5 allows in addition the control of a third function (i.e., the adjustment of the tilting tension of the back).

Figure 4A:
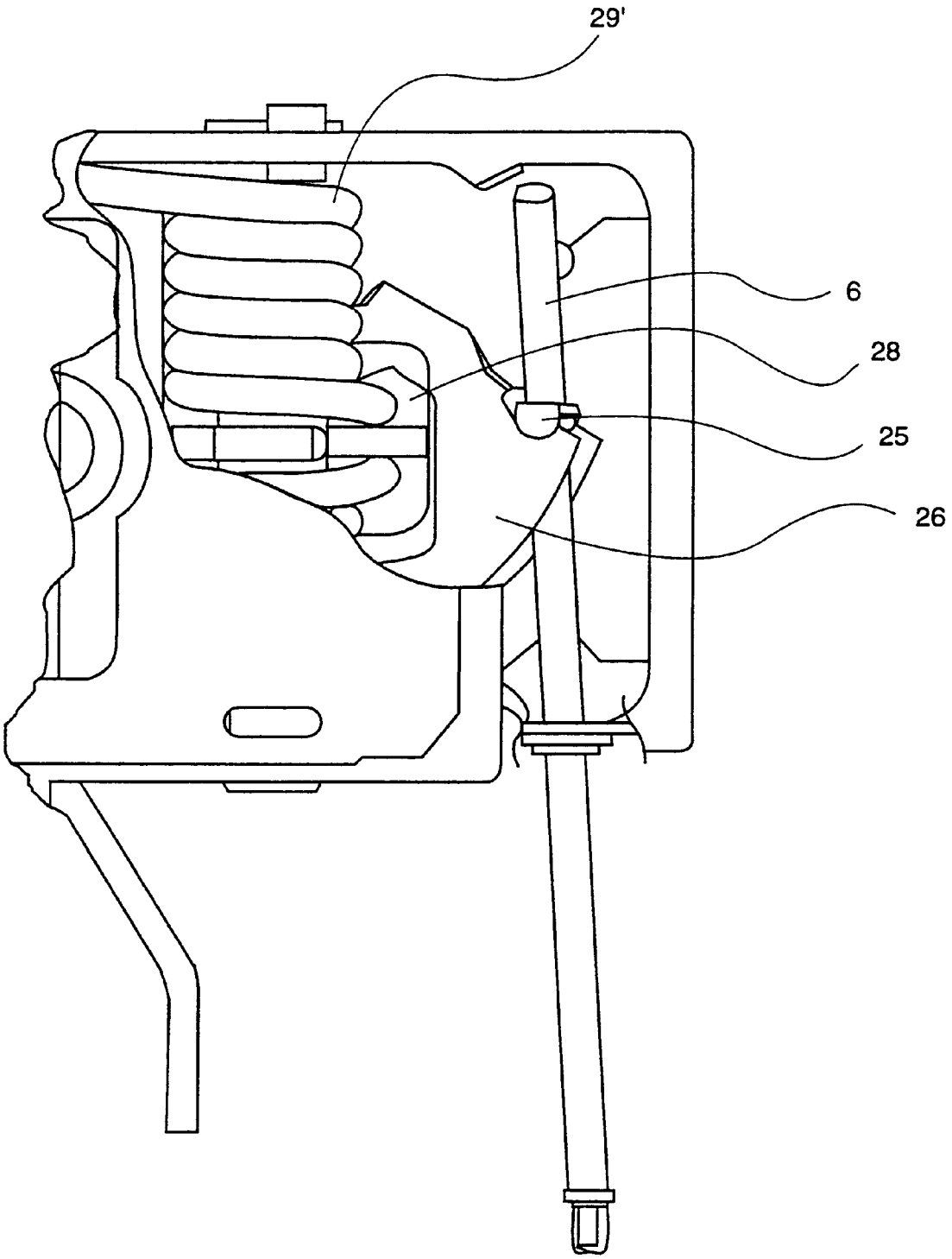
FIGS. 4*a* and 4*b* are partial top views showing more clearly some elements of the mechanism of adjustment of the tilt tension.
Figure 4B:
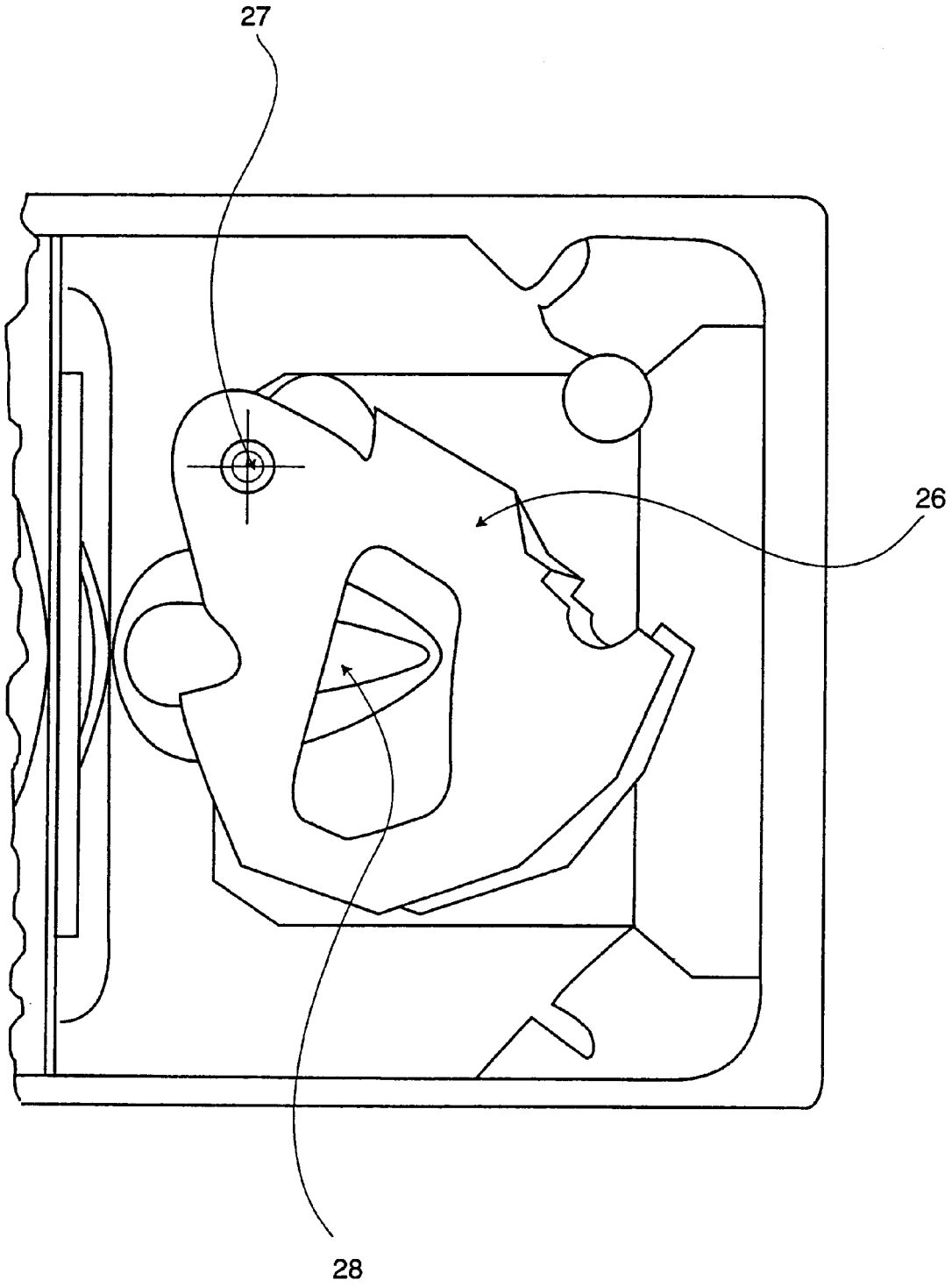

To this effect, the shaft 5, which can rotate freely inside the shaft 7, extends into the casing part 1 in which it ends by a threaded portion 6. Upon said threaded portion 6 is screwed a nut 24 (FIGS. 1 and 4*a*) which through a pin 25 drives an arm 26 pivotally mounted upon a slant axis 27 (FIG. 4*b*). The arm 26 engages a plate 28 to which are fixed both ends of a couple of coiled springs 29 and 29' which are wound around the axis 3 around which the part 2 of the casing (which is connected to the back) is tilting.

By rotating the axially fixed threaded portion 6, the nut 24, which is rotatively fixed, axially moves in one direction to the other, driving through the pin 25 the arm 26 pivoting around the slant axis 27. Due to this obliqueness, the plate 28 takes a swinging movement pressing correspondingly more or less upon the ends of the springs 29 and 29', which modifies correspondingly the torque of springs 29 and 29' and therefore the tilting tension, which corresponds to the effort requested by the user to recline the back.

The closeness of knob 5 and crown 8 allows therefore to control substantially simultaneously the adjustment of all the functions of the back.

It is to be noted that the axial movement of the crown 8 does not interfere with its angular movement, the plays between the various movable elements allowing the functioning of the rod 11, even when and if it is slightly oblique due to the translation of the shaft 7.

Figure 5:
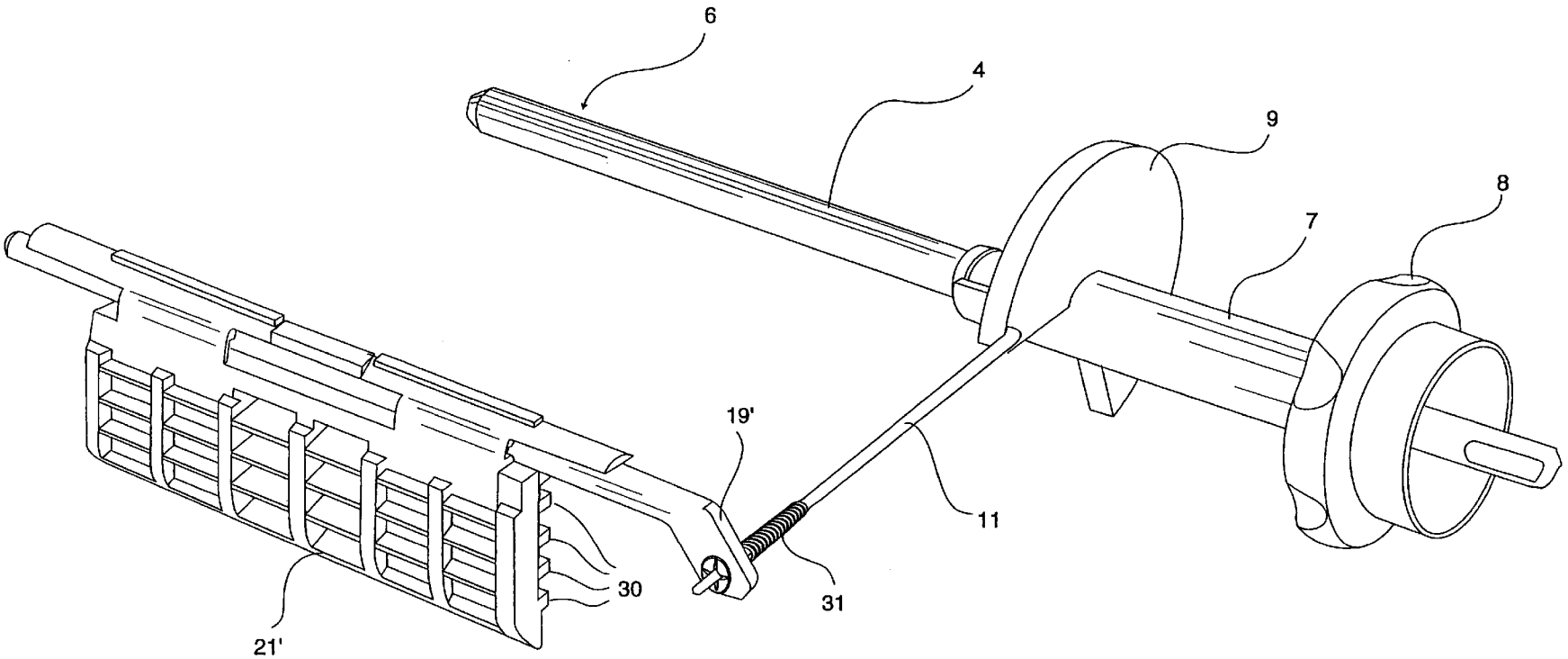
FIG. 5 shows a modification of the locking mechanism of the back in various positions.

FIG. 5 illustrates a modification of the mechanism providing a locking of the tilting angle of the back. The crown 8, the shaft 7, the sector 9, and the connecting rod 11 are the same as previously described, but the lever 19' moves in a perpendicular plan by difference with lever 19, to allow a better transmission of the movement of the connecting rod to an element 21'. The element has the same purpose as element 21, but not only offers two locking positions, but four, due to four ribs 30 which can be used each at will depending upon the rotation angle of crown 8. In a known manner, a spring 31 makes the change of rib of the element 21' easier, when it rotates.

As already mentioned, the above description is given as an illustrative and not limitative example of modification of the invention and many further modifications can be designed in the scope of the invention. For example, the satellite is shown here laterally along the seat. It could be placed in any further place for any practical and/or aesthetic reasons.

The satellite contains the controls of the three specific adjustments. It could also contain a different number of adjustments, which could be different according to the user's needs. The invention is therefore limited only by the following claims.

The invention claimed is:

1. A method of assembling a chair control for a chair having movable parts, the method comprising steps of:

providing a control housing;

providing a multi-functional member operably supported on the control housing, the multi-functional member including a first control member constructed to translate for controlling a first one of the movable parts, and constructed to rotate for controlling a second one of the movable parts, the first control member including a rotatable sector having an arcuate slot, and including a cable adapted for connection to the first one of the movable parts, the cable including a first end; and slidably retaining the first end in the arcuate slot so that the first end slides in the arcuate slot when the first control member is rotated, and translates when the first control member is translated.

2. The method defined in claim 1 wherein the multi-functional member includes a second control member for controlling a third one of the movable parts, and including a step of operably supporting one of the first and second control members on the other of the first and second control-members.

3. The method defined in claim 2 wherein the first control member is operably mounted on the second control member.

4. The method defined in claim 3 wherein the second control member includes a threaded section, and including a step of threadably engaging the second control member with a nut operably connected to the third one of the movable parts.

5. A method of assembling a chair control having movable parts, and a reclineable back, comprising steps of:

providing a control housing;

providing a multi-functional member operably supported on the control housing, the multi-functional member including a first control member constructed to translate for controlling a first one of the movable parts, and constructed to rotate for controlling a second one of the movable parts, and a second control member located proximate the first control member, the second control member being constructed to control a third one of the movable parts, the first and second control members including first and second spindles, respectively; and operably mounting the first spindle on the second spindle and attaching the first spindle to the first and second movable parts so that the first movable part is operated when the first spindle is translated and so that the second movable part is operated when the first spindle is rotated.

6. The method defined in claim 5 wherein the second spindle includes a threaded section.

7. The method defined in claim 5 including a cable operably connected to the first control member and to the first one of the movable parts.

8. The method defined in claim 5 including a rod operably connected to the first control member and to the second one of the movable parts.

9. A method of assembling a chair comprising steps of:

providing a seat;

providing a reclineable back;

providing a control housing including a cable;

assembling the seat, the reclineable back and the control housing, with at least one of the seat, the reclineable back, and the control housing having movable parts, and with the cable attached to a first one of the movable parts;

providing a multi-functional member operably supported on the control housing, the multi-functional member including a first control member constructed to translate for controlling the first one of the movable parts, and constructed to rotate for controlling a second one of the movable parts, the first control member including a rotatable sector having an arcuate slot, and the cable including a first end; and slidably retaining the first end in the arcuate slot so that the retained end slides in the arcuate slot and does not activate the first one of the movable parts when the first control member is rotated, but translates and does activate the first one of the movable parts when the first control member is translated.

10. A method of assembling a chair comprising steps of:

providing a seat;

providing a reclineable back including a back support pivoted to a control housing and supporting the reclineable back;

providing a control housing including a rotary cam and a linkage;

assembling the seat and the reclineable back to the control housing with at least one of the seat, the reclineable back, and the control housing having movable parts;

providing a multi-functional member operably supported on the control housing, the multi-functional member including a first control member constructed to translate for controlling a first one of the movable parts, and constructed to rotate for controlling a second one of the movable parts, and including a second control member constructed to rotate for controlling a third one of the movable parts; and operably connecting the linkage to one of the first and second control members for rotating the cam upon operation of the one control member, the cam being constructed to engage a portion of the back support to selectively immobilize the back support.

11. The method defined in claim 10 wherein the linkage comprises a rod, and wherein the step of operably connecting includes positioning a bent end of the rod in a hole in the first control member.

12. A method of adjusting a chair including steps of:

providing a chair including a seat, a reclineable back, a control housing including an elongated connector;

the seat, the reclineable back, and the control housing having movable parts, the control housing further including a multi-functional member including a first control member mounted to a second control member, the first control member constructed to translate and control the first one of the movable parts, and constructed to rotate and control a second one of the movable parts, and the second control member constructed to rotate and control a third one of the movable parts;

rotating the first control member to control the first one of the movable parts;

translating the first control member to control the second one of the movable parts; and rotating the second control member to control the third one of the movable parts.

13. The method defined in claim 12 including a cable connecting the first control member to the first one of the movable parts.

14. The method defined in claim 13 wherein the first one of the movable parts comprises a release button on a vertical height adjustment mechanism.

15. The method defined in claim 13 wherein the third one of the movable parts comprises a spring tension adjustment mechanism for adjusting tension on a spring that biases the reclineable back toward an upright position.

16. The method defined in claim 12 wherein the third one of the movable parts comprises a spring tension adjustment mechanism for adjusting tension on a spring that biases the reclineable back toward an upright position.

17. The method defined in claim 12 including a rod connecting the second one of the movable parts to the first control member.

18. A method of adjusting a chair including steps of:

providing a chair including a seat, a reclineable back, and a control housing including an elongated connector;

the seat, the reclineable back, and the control housing having movable parts including a first movable part including a release button on a vertical height adjustment mechanism and a second movable part including a cam constructed to engage and control movement of the reclineable back, the control housing further including a multi-functional member including a first control member and a cable connecting the first control member to the release button to control the release button, and further constructed to rotate and control the cam, the multi-functional member further including a second control member constructed to rotate and control a third one of the movable parts;

rotating the first control member to control the release button;

translating the first control member to control the cam; and rotating the second control member to control the third one of the movable parts.

* * * * *